United States Patent [19]

Gillings

[11] Patent Number: 4,857,873

[45] Date of Patent: Aug. 15, 1989

[54] MAGNET STRUCTURE

[76] Inventor: Anthony R. Gillings, Unit 3/33 Binney Road, Blacktown, New South Wales 2148, Australia

[21] Appl. No.: 232,325

[22] Filed: Aug. 12, 1988

[30] Foreign Application Priority Data

Aug. 14, 1987 [AU] Australia ..... PI3743

[51] Int. Cl.[4] ..... H01F 7/20

[52] U.S. Cl. ..... 335/285; 433/189

[58] Field of Search ..... 335/302, 303, 306, 285, 335/295; 433/189

[56] References Cited

FOREIGN PATENT DOCUMENTS 2587895 4/1987 France ..... 433/189

*Primary Examiner*—George Harris

*Attorney, Agent, or Firm*—Ostrolenk, Faber, Gerb & Soffen

[57] ABSTRACT

A magnet structure which is intended for use in retaining dental prostheses and which is arranged when in situ to provide a closed magnetic field. The magnet structure has a high strength permanent magnet element, a carrier for the magnet element and a cap which is fitted to the magnet structure. The carrier is formed entirely from a magnetizable material and it has a pair of spaced-apart pole pieces which sandwich the magnet element, which are connected by a web of metal and which have pole face portions disposed in a common plane with the connecting web. The pole face portions and the connecting web form a substantially flat base surface, and the cap, which is formed of non-magnetizable material, is fitted to the magnet structure in a manner such that it envelopes all but the base surface of the structure.

8 Claims, 2 Drawing Sheets

MAGNET STRUCTURE

FIELD OF THE INVENTION

This invention relates to a magnet structure which is suitable for use in retaining dental prostheses. The invention is hereinafter described in the context of a magnet structure which is intended for use in an over-denture, but it will be understood that the device may have other and more general applications.

BACKGROUND OF THE INVENTION

During the past 20 years, permanent magnet alloys of high field strength and high resistance to demagnetisation have been developed, these alloys permitting the use of magnets in applications not previously considered possible. A typical example resides in the use of permanent magnets to hold dentures in place in the mouth, the magnets being located in the dentures and being attractively coupled to keepers that are attached to teeth roots or implants. Magnet alloys in common use for this purpose are those based on cobalt and samarium, and iron, neodymium and boron.

A number of different arrangements employing closed field permanent magnets and pole pieces have been proposed for use in denture retention systems. In this regard reference may be made to U.S. Pat. Nos. 4209905 and 4302189 (both to Gillings), 4431419 (Portnoy), 4508507 (Jackson) and 4626213 (Shiner). These closed field arrangements have been adopted in favour of more elementary (open field) retention systems because they confer two advantages. In the first place, they reduce substantially the external magnetic fields which are associated with open field magnet systems. Secondly, the reduction in external magnetic fields is usually accompanied by a considerable increase in the retention provided.

The reduction in external magnetic fields is desirable because some authorities believe that there is a remote possibility that such fields may have noxious effects on living tissues. The increase in available retention is desirable because it enables a denture to be held in place more firmly or, alternatively, allows the construction of devices that are much smaller than those that employ open field magnet elements.

However, a disadvantage of the presently available high strength magnet alloys is that they are susceptible to corrosion when used in the mouth if not protected against oral fluids. The corrosion products are not toxic or damaging to denture wearers, but the effect of the corrosion is to reduce available retention and, in some cases, this reduction may be so great that retention is lost completely. For this reason, most commercial manufacturers seek to protect the magnetic denture retention devices against corrosion. Plastic and electroplated coatings have been tried but have been found to be unsatisfactory and some (if not all) manufacturers currently enclose their magnets in thin corrosion-resistant metal casings.

However, the devices which have encased magnet elements can be difficult to manufacture and/or have other disadvantages. One such device employs a non-magnetic sleeve to encase the periphery of its magnet element, and non-corrosive magnetisable material side plates are glued to the opposite pole faces of the magnet element, such that the entire surface of the magnet element is covered by either the sleeve or the side plates. The side plates themselves constitute north and south pole pieces which in use abut a keeper to form a closed field magnetic system. Although this device has been used extensively and sucessfully, it is known that excessive biting forces can cause the glued joint to fail, allowing ingress of oral fluid and resultant corrosion.

Another magnet system which currently is marketed has a cylindrical magnet which is capped at both ends by concentrically disposed inverted cups. The lip of one of the cups extends to and surrounds the base of the other, such that concentric pole faces are created, one being circular and the other being annular. However, this structure does have a poor retentivity-to-size ratio.

A further known magnet system employs a cylindrical magnet element which is positioned within two recessed hemispherical keeper plates, with the plates being separated by a small gap. The plates form north and south pole units and the gap between the plates is filled with a non-magnetisable low melting temperature solder. This particular product does exhibit high retentivity but it is bulky and is expensive to produce. Also, the solder can wear or corrode in the oral environment.

SUMMARY OF THE INVENTION

The present invention is directed to a magnet structure which makes use of the remarkably high retentivity of modern magnet materials and which provides a convenient approach to encasing the magnet element against attack from oral fluids.

Thus, the present invention provides a magnet structure which comprises a high strength permanent magnet element and a carrier for the permanent magnet element. The carrier has a pair of spaced-apart pole pieces which are formed from a magnetisable material, which sandwich the magnet element, which are connected by a web of metal and which have pole face portions disposed in a common plane with the connecting web. The pole face portions and the connecting web form a substantially flat base surface of the magnet structure and a cap of non-magnetisable material envelopes all but the base surface of the structure.

The magnet element within the defined structure is totally cocooned and protected from environmental attack by the base surface and the cap of non-magnetisable material.

PREFERRED FEATURES OF THE INVENTION

The web of metal which joins the two pole pieces may be composed of a material which is the same as that in the pole pieces, in which case the carrier may be formed as an integral element from a single piece of magnetisable metal. In the alternative, the two pole pieces may be formed of one material and the web be formed of another (non-magnetisable) material with the three components of the carrier structure being bonded together.

The web of metal preferably has a thickness in the range 0.075 to 0.500 mm and most preferably has a thickness in the order of 0.15 to 0.25 mm.

The invention will be more fully understood from the following description of a preferred embodiment of the magnet structure as shown in the accompanying drawings.

DETAILED DESCRIPTION OF THE INVENTION

Figure 1:
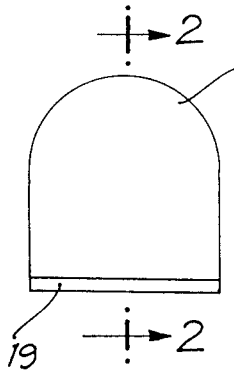
FIG. 1 shows an elevation view of the complete magnet structure.
Figure 2:
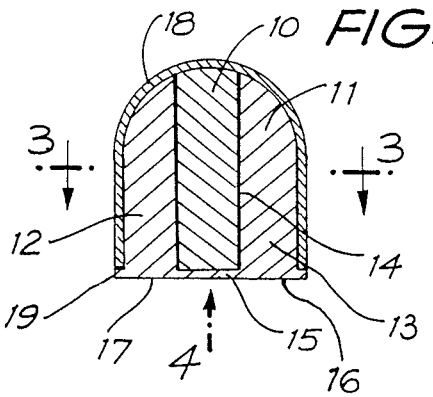
FIG. 2 shows a sectional elevation view of the structure, as seen in the direction of section plane 2—2 in FIG. 1.
Figure 3:
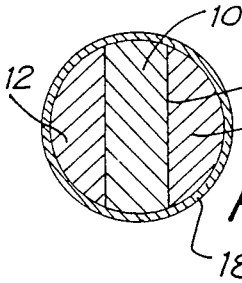
FIG. 3 shows a sectional plan view of the structure, as seen in the direction of section plane 3—3 in FIG. 2.
Figure 4:
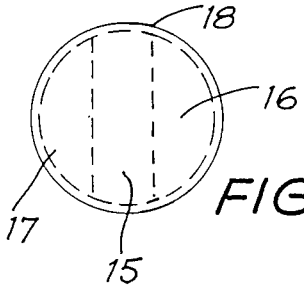
FIG. 4 shows an inverted plan view of the structure, as seen in the direction of arrow 4 shown in FIG. 2.

As illustrated in FIGS. 1 to 4, the magnet structure comprises a magnet element 10 which is located in what might be called a magnet retainer or carrier 11. The retainer 11 has opposite pole pieces 12 and 13, a dividing slot 14 and a connecting web 15. The lower surfaces of the pole pieces 12 and 13 constitute pole faces 16 and 17 which lie in the same plane as the web 15 and together with the web form a flat base surface of the complete structure.

The magnet element 10 is shaped to locate within and occupy substantially the full volume of the slot 14 and the side walls of the slot are a tight fit against opposite (north and south) pole faces of the magnet element. Apart from the base surface, the entire structure is enveloped by a metal cap 18 which is formed from a non-magnetisable material. The cap 18 is press fitted to the structure and glued in place, and the cap engages a small flange 19 surrounding the base of the retainer 11.

The magnet element 10 is preferably formed from neodymium, iron, boron alloy. The retainer 11 may be formed from Series 416 magnetisable stainless steel, although it will be understood that other corrosion resistant magnetisable materials may be employed. The cap 18 is formed from Series 316 non-magnetic stainless steel, although here too it will be understood that other non-corrosive non-magnetisable materials may be used.

The magnet retainer 11 might typically be 4 mm in diameter and have a slot which is 1.5 mm wide. Also, the retainer might be dimensioned such that it is 2.6 mm high and have a web thickness in the order of 0.15 to 0.25 mm.

Figure 5:
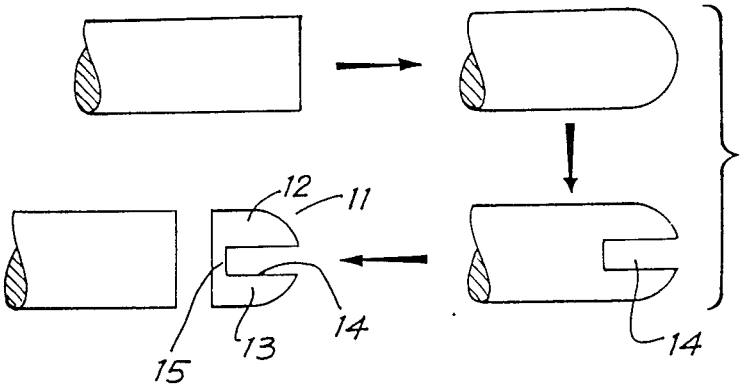
FIG. 5 shows four sequential steps which may be employed in the manufacturing of a retainer or carrier portion of the magnet structure.

The magnet element 10 might be formed from a bar of substantially cylindrical material having a flat surface such that it will sit neatly in the slot and on the web 15, and the magnet retainer 11 may be fabricated using a technique which is illustrated by the sequential stages shown in FIG. 5 of the drawings. That is, the end portion of a cylindrical bar may first be formed with a domed head and the domed head be then milled or otherwise slitted to form the slot 14. Finally, the domed and slitted stock may be parted from the remaining portion of the rod at a position to provide the required web thickness.

The web 15 which joins the two pole faces 12 and 13 does, of course, provide a leakage path for the magnetic field which flows through the magnet and pole pieces. However, by constructing the web in such a way that it has a very small thickness relative to the cross-sectional thickness of the pole pieces, very little loss of magnetic retentivity is experienced. Experiments have established that it is possible to make the web 15 sufficiently thin to restrict the passage of the magnetic field and, thus, prevent excessive loss of retention, but sufficiently thick to provide strength to hold the pole pieces 12 and 13 together and allow some wear at the base surface of the structure without exposing the magnet to corrosive chemicals. A web thickness in the order of 0.15 to 0.25 mm meets these criteria.

Figure 6:
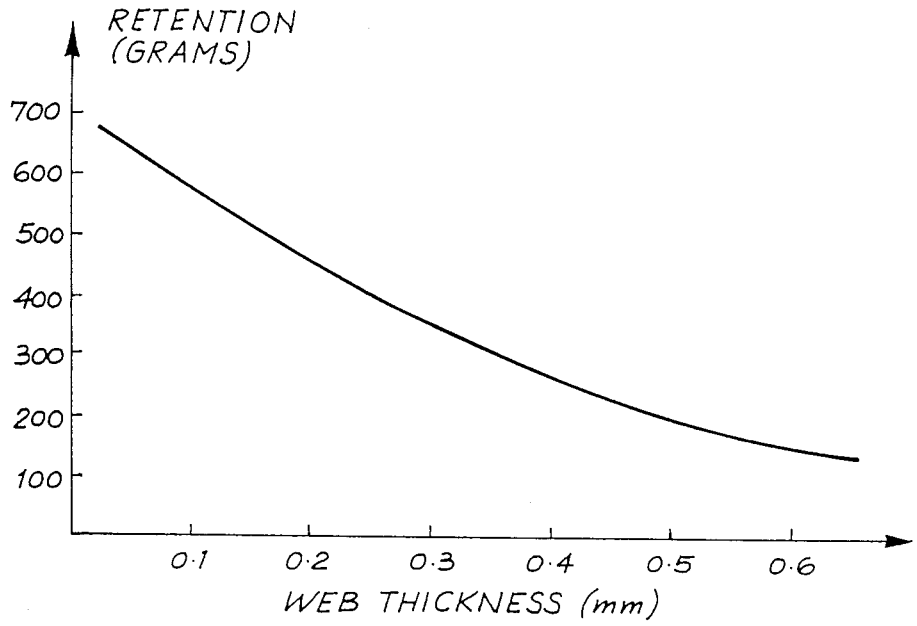
FIG. 6 shows a graph of magnetic retention against web thickness for a magnet structure of the type shown in FIGS. 1 to 5.

FIG. 6 of the drawings shows a graph in which magnetic retention (measured in grams) is plotted against the thickness (measured in mm) of the web. The graph is typical of a magnet structure which is formed in the above described manner, and it shows that a retention exceeding 500 grams is obtainable with a web thickness in the order of 0.15 mm. This web thickness provides an acceptable compromise between ease of manufacture, provision of adequate retention and allowance for wear at the base of the magnet structure.

Figure 7:
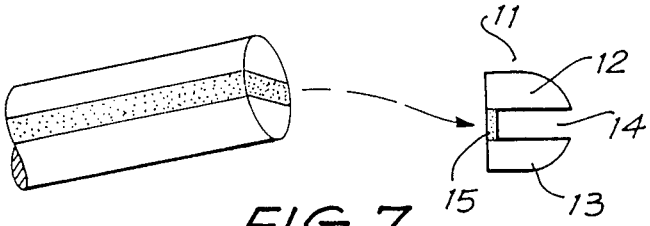
FIG. 7 shows an alternative procedure for use in manufacturing the retainer portion of the magnet structure.

However, as shown in FIG. 7 of the drawings, it is possible to construct the magnet retainer 11 in such a way that the middle portion of the bar stock (that is the portion which forms the web 15) is formed from non-magnetisable alloy. The non-magnetisable alloy constitutes a central strip of the bar stock and two magnetisable material sections are welded or soldered to each of its sides.

In use of the retainer shown in FIG. 7 the web 15 may be formed with any desired thickness since no leakage will occur through the web.

The magnet element 10 and the retainer 11 need not be formed in the shape shown in the drawings but may, for example, be formed such that the magnet element 10 has a fan or wedge-shape, with the retainer 11 being formed as two wedges which serve to nest and, hence, sandwich the magnet element.

I claim:

1. A magnet structure which comprises a high strength permanent magnet element and a carrier for the permanent magnet element, the carrier having a pair of spaced-apart pole pieces which are formed from a magnetisable material, which sandwich the magnet element, which are connected by a web of metal and which have pole face portions disposed in a common plane with the connecting web, the pole face portions and the connecting web forming a substantially flat base surface of the magnet structure, and a cap of non-magnetisable material being fitted to the magnet structure in a manner such that it envelopes all but the base surface of the structure.

2. The magnet structure as claimed in claim 1 wherein the web is formed from the same magnetisable material as the pole pieces of the carrier.

3. The magnet structure as claimed in claim 1 wherein the web is formed from a non-magnetisable metal which interconnects the pole pieces of the carrier.

4. The magnet structure as claimed in claim 2 wherein the web has a thickness in the range 0.075 to 0.500 mm.

5. The magnet structure as claimed in claim 2 wherein the web has a thickness in the order of 0.15 to 0.25 mm.

6. The magnet structure as claimed in claim 1 wherein the magnet element is formed from a neodymium-iron-boron alloy.

7. The magnet structure as claimed in claim 1 wherein the cap is formed from metal and is glued to the underlying structure.

8. The magnet structure as claimed in claim 1 wherein the base surface is formed with a surrounding flange which is abutted by a marginal edge of the cap.

* * * * *